US006190164B1

(12) United States Patent
Ueno et al.

(10) Patent No.: US 6,190,164 B1
(45) Date of Patent: Feb. 20, 2001

(54) CONTINUOUS HEAT TREATING FURNACE AND ATMOSPHERE CONTROL METHOD AND COOLING METHOD IN CONTINUOUS HEAT TREATING FURNACE

(75) Inventors: Naoto Ueno; Sachihiro Iida; Ichiro Samejima, all of Tokyo (JP)

(73) Assignee: Kawasaki Steel Corporation, Hyogo (JP)

( * ) Notice: Under 35 U.S.C. 154(b), the term of this patent shall be extended for 0 days.

(21) Appl. No.: 09/424,546

(22) PCT Filed: Mar. 25, 1999

(86) PCT No.: PCT/JP99/01498

§ 371 Date: Nov. 24, 1999

§ 102(e) Date: Nov. 24, 1999

(87) PCT Pub. No.: WO99/50464

PCT Pub. Date: Oct. 7, 1999

(30) Foreign Application Priority Data

Mar. 26, 1998 (JP) ..... 10-100536

(51) Int. Cl.[7] ..... F27D 1/18

(52) U.S. Cl. ..... 432/242; 432/8; 432/59; 432/77; 34/242

(58) Field of Search ..... 432/8, 59, 77, 432/242; 34/242

(56) References Cited

U.S. PATENT DOCUMENTS 4,133,634 * 1/1979 Wang ..... 432/2
4,746,289 * 5/1988 Guillaume ..... 432/8
4,923,396 * 5/1990 Harada et al. ..... 432/59
5,685,088 * 11/1997 Nakamura ..... 34/242

FOREIGN PATENT DOCUMENTS 55-1969 1/1980 (JP) .
59-133330 7/1984 (JP) .
6-346156 12/1994 (JP) .
7-278679 10/1995 (JP) .
9-125155 5/1997 (JP) .
9-235626 9/1997 (JP) .

* cited by examiner

*Primary Examiner*—Denise L. Ferensic
*Assistant Examiner*—Jiping Lu
(74) *Attorney, Agent, or Firm*—Young & Thompson

(57) ABSTRACT

A continuous heat treatment furnace having one of a plurality of furnace zones except for first and last zones as a rapid cooling zone 11 for rapidly cooling a material by blowing an atmospheric gas, which comprises a roll-sealed chamber 3 partitioned at the inlet by first and second roll sealing devices 4A and 4B from the upstream and a third roll sealing device 4C at the outlet as sealing means for atmospheric gas, and in which the inlet of the first roll sealing device and the outlet of the third roll sealing device are connected, and/or the roll-sealed chamber and an uppermost stream portion 6 in the rapid cooling zone are connected, and in which the hydrogen concentration in the furnace is controlled to 10% or higher in the rapid cooling zone and is controlled to 10% or lower in the furnace zone at the inlet of the rapid cooling zone. A continuous heat treatment furnace capable of simply preventing mixing of atmospheric gases in the rapid cooling zone and the atmospheric gas in the zone (heating zone, cooling zone or the like) adjacent with the rapid cooling zone of a gas jet cooling system, and a method of controlling the atmospheric gas in the furnace capable of preventing nitridation are provided.

5 Claims, 8 Drawing Sheets

CONTINUOUS HEAT TREATING FURNACE AND ATMOSPHERE CONTROL METHOD AND COOLING METHOD IN CONTINUOUS HEAT TREATING FURNACE

TECHNICAL FIELD

The present invention concerns a continuous heat treatment furnace and, more specifically, it relates to a continuous heat treatment furnace to be us ed for continuous heat treatment of metal strips such as strip-like materials, for example, of steel and aluminum and an operation method therefor.

BACKGROUND OF THE TECHNIQUES

In the present invention, "%" for hydrogen concentration means "% by volume" here and hereinafter.

The continuous heat treatment furnace is, basically, a facility for applying heat treatment of a predetermined heat pattern while continuously passing strip-like materials such as steel strips, which is constituted by successively disposing furnace zones each having a processing performance of heating/soaking/cooling (slow cooling and rapid cooling) in the order of treatment.

For example, a continuous heat treatment furnace for a cold-rolled steel strips comprises, as shown in FIG. 4, a heating zone 10 for heating a steel strip S to a predetermined temperature, or further soaking or further slowly cooling the same, a rapid cooling zone 11 for rapidly cooling in a predetermined temperature range and a cooling zone 12 for cooling it to a predetermined treatment completion temperature or averaging it before cooling, arranged and constituted in the order of treatment.

If the surface of materials is oxidized during heat treatment, the appearance of the products is deteriorated, so that the inside of the continuous heat treatment furnace is controlled to a non-oxidative atmosphere. In a continuous heat treatment furnace for steel strips, a mixed gas (HN gas) of a hydrogen gas and a nitrogen gas containing several % of hydrogen gas is generally used as an atmospheric gas.

When such HN gas is used, hydrogen contributed to reduction is consumed and formed into $H_2O$ along with the progress of the heat treatment, and the atmosphere inside the furnace can no more be kept to a non-oxidative state. Therefore, a discharge pipe and a supply pipe for the atmospheric gas are disposed to each of the furnace zones to discharge spent gases and supply fresh gases thereby keeping a predetermined hydrogen concentration in the furnace.

By the way, the composition of the atmospheric gas is not always identical for every furnace zone but, as described below, a composition of atmospheric gas different from others is sometimes adopted in a certain furnace zone depending on the characteristics to be provided to steel strips.

For example, for low carbon steel having a C content of from 0.01 to 0.02 wt %, a so-called overaging treatment of heating, soaking and then rapidly cooling a steel strip to solid-solubilize C in the steel to supersaturation and then keeping it at about 400° C. is conducted in order to improve the aging property. Rapid cooling technique in this case can include a gas jet cooling method of cooling/recycling an atmospheric gas by a heat exchanger, and blowing it as a high speed gas jet stream from gas jet chambers 13 as shown in FIG. 4 to a steel strip, a roll cooling method of urging a cooling roll having coolants filled therein to a steel strip and a water cooling method or a mist cooling method of blowing water or mist to a steel strip. Among them, the gas jet cooling method can provide satisfactory appearance and shape to the steel strip after cooling and is less expensive in view of facilities compared with other methods.

However, the gas jet cooling method has a drawback of low cooling rate. In order to overcome the drawback, Japanese Patent Examined Publication Sho 55-1969, Japanese Patent Unexamined Publication Hei 6-346156 and Japanese Patent Unexamined Publication Hei 9-235626 have disclosed the use of an HN gas having a cooling performance enhanced by increasing a hydrogen concentration in a rapid cooling zone. Then, satisfactory rapid cooling at a cooling rate over 50° C./s is possible in the rapid cooling zone.

When using an atmospheric gas in a certain furnace zone different from that in other furnace zones, it is necessary to avoid mixing with atmospheric gases from those of other furnace zones. Therefore, sealing means are disposed at the boundary with other furnace zones.

Concrete structures or devices for known sealing means can include, for example, (A) a plurality of partition wall structures which also serve as processing chambers disposed to the boundary between each of atmospheric gases of different compositions and capable of supplying/discharging the atmospheric gases of different compositions (Japanese Patent Unexamined Publication Hei 5-125451), (B) a device for sliding contact of a seal member with a steel strip (Japanese Utility Model Examined Publication Sho 63-19316), (C) a device comprising a combination of sealing rolls, blow nozzles and sealing dampers (Japanese Patent Unexamined Publication Sho 59-133330), and (D) a roll-sealing device 4 comprising rolls rotating at the same speed as the passing speed of a material while putting the material between them from the front and back surfaces of the material as shown in FIG. 4. Further, in a rapid cooling zone 11 of FIG. 4, a roll-sealing device 4 is disposed not only to the entrance and the exit but also to the exit at the upstream of the rapid cooling zone in which gas jet chambers 13 are disposed.

Among such sealing means, scratches are caused to the steel strip by contact with the sealing member in (B). This risk is particularly large under heat treatment condition of high passing speed. In (A) and (C), a consumption of atmospheric gas is worsened, since the flow rate of the sealing gas has always to be kept and, in addition, a gas flow rate at high accuracy is necessary for ensuring the sealing performance, to make the facility expensive. On the contrary, no scratches are caused to steel strips and the facility is inexpensive in (D).

As described above, in the rapid cooling zone of the continuous heat treatment furnace, it is advantageous to adopt a gas jet cooling method of using an HN gas at a higher hydrogen concentration than that in other furnace zones (heating zone, cooling zone or the like) and recycling/cooling and blowing the gas to the steel strips in view of the surface property of products and the cost for facilities. It is advantageous to adopt the roll-sealing device as the sealing means with the same viewpoint.

However, as actually shown in FIG. 4, when roll-sealing devices 4 are disposed before and after (at the entrance and exit) of the rapid cooling zone 11 to completely shield the atmospheric gas at high hydrogen concentration in the rapid cooling zone, a dynamic pressure is generated by the stream formed by the atmospheric gas at high hydrogen concentration blown to the strip material and flowing along the strip-like material in the rapid cooling zone (also called as an entrained stream). The dynamic pressure thus generated is interrupted by the roll-sealing devices to result in elevation of a static pressure in the vicinity of the roll-sealing devices. For example, FIG. 5 shows the result of measurement for the static pressure (FIG. 5(*a*)) and the hydrogen concentration in the atmospheric gas (FIG. 5(*b*)) at points P1 to P9 in the rapid cooling zone and before and after the zone when a strip material having a 0.8 mm thickness and a 1250 mm width is passed through the continuous heat treatment furnace at a line speed of 400 mpm. As can be seen from FIG. 5(*a*), large static pressure gaps are caused at some points. Therefore, the balance of the furnace pressures is lost in the rapid cooling zone and before and after of the zone to cause large gas streams, as a result, the atmospheric gas at a high hydrogen concentration in the rapid cooling zone is flown out of the rapid cooling zone, and the hydrogen concentration in the rapid cooling zone is lowered as shown in FIG. 5(*b*). It is necessary to increase the amount of the HN gas at a high hydrogen concentration to be charged in order to compensate the lowering of the hydrogen concentration in the rapid cooling zone, which results in worsening of the RN gas consumption.

After all, provision of a strong sealing device in order to prevent the gas flow leads to an unintentional result of inducing the gas flow due to the distribution of the furnace pressure (atmospheric pressure inside the furnace). Such problems are not taken into consideration in existent sealing means.

In addition, it has been found by the recent study of the inventors that the discharge of the atmospheric gas at high concentration from the rapid cooling zone not only leads to the worsening of HN gas consumption but also gives an influence on the crystal structures of the strip-like material during recrystallization upstream to the rapid cooling zone. Namely, it has been obtained such a finding that if the hydrogen concentration in the furnace zone in adjacent with the inlet of the rapid cooling zone is increased to higher than 10%, nitridation proceeds at the surface layer of the strip material in a state of a high temperature before rapid cooling, resulting in a problem of causing partial hardening to the surface layer.

In view of the foregoing problems of prior art, an object of the present invention is to provide a continuous heat treatment furnace having a rapid cooling zone of a high hydrogen concentration, capable of properly controlling the hydrogen concentration of an atmospheric gas in a furnace zone for heating and keeping after heating and the hydrogen concentration in the atmospheric gas in the rapid cooling zone, and excellent in the HN gas consumption, by preventing mixing between the atmospheric gas at high hydrogen concentration in the rapid cooling zone and the atmospheric gas in the zones in adjacent with the rapid cooling zone a (heating zone, cooling zone and the like) of a gas jet cooling system.

Disclosure of the Invention

The present invention provides a method of controlling an atmosphere in a continuous heat treatment furnace of heat-treating a strip-like material in an atmospheric gas, heating the strip-like material in the course of the treatment and then rapidly cooling it by blowing a hydrogen-containing gas, wherein the hydrogen concentration in the atmospheric gas in the furnace zone for heating the strip-like material and the furnace zone for keeping it after the heating is controlled to 10% or lower (first invention).

The present invention also provides a cooling method of heat-treating a strip-like material in an atmospheric gas, heating the strip-like material in the course of the treatment and then rapidly cooling it by blowing a hydrogen-containing gas, wherein the hydrogen gas concentration of the atmospheric gas in the furnace zone for heating the strip-like material and a furnace zone for keeping it after heating is controlled to 10% or lower, the tension per unit cross section of the material: Tu (kgf/mm$^2$) is kept within a range capable of satisfying the following conditions (formula corresponding to any one of the formulae (1) to (3)) depending on the thickness t (mm), the width W (mm) of the strip material, and a hydrogen-containing gas at a hydrogen concentration of 10% or higher is blown to the material (second invention).

Note (a) Under the condition: W<1350 mm $$1.88-0.18\times t-0.00080\times W \leqq Tu \leqq 2.38-0.11\times t-0.00084\times W \quad (1)$$

(b) Under the condition: W≧1350 mm and t≦0.85 mm $$0.73+0.38\times t-0.00030\times W \leqq Tu \leqq 1.23+0.35\times t-0.00028\times W \quad (2)$$

(c) Under the condition: W≧1350 mm and t>0.85 mm $$1.10-0.00033\times W \leqq Tu \leqq 1.54-0.00029\times W \quad (3)$$

Further, the present invention provides a continuous heat treatment furnace having a plurality of furnace zones arranged successively for the heat treatment of a strip-like material in an atmospheric gas, wherein one of the furnace zones except for the first and last zones is a rapid cooling zone for rapidly cooling the material by blowing an atmospheric gas, which comprises a first roll sealing device at an entrance and a second roll sealing device at an exit as atmospheric gas sealing means, and in which the inlet of the first roll sealing device and the outlet of the second roll sealing device are connected (third invention).

The present invention also provides a continuous heat treatment furnace having a plurality of furnace zones arranged successively for the heat treatment of a strip-like material in an atmospheric gas, wherein one of the furnace zones except for the first and last zones, is a rapid cooling zone for rapidly cooling the material by blowing an atmospheric gas, and comprises a roll-sealed chamber partitioned by first and second roll sealing devices from the upstream at an entrance and a third roll sealing device at the exit as atmospheric gas sealing means, in which the roll-sealed chamber and an upstream portion in the rapid cooling zone are connected (fourth invention)

The prevent invention also provides a continuous heat treatment furnace having a plurality of furnace zones arranged successively for the heat treatment of a strip-like material in an atmospheric gas, wherein one of the furnace zones except for the first and last zones is a rapid cooling zone for rapidly cooling the material by blowing an atmospheric gas, and comprises a roll-sealed chamber partitioned by first and second roll sealing devices from the upstream at the entrance and a third roll sealing device at the exit as atmospheric gas sealing means, in which the inlet of the first roll-sealing device and the outlet of the third roll-sealing device are connected, and the roll-sealed chamber and an upstream portion in the rapid cooling zone are connected (fifth invention).

The present invention further provides an invention as defined in any one of third to fifth inventions wherein bridle rolls are disposed before and the after the rapid cooling zone (sixth invention).

References in each of the drawings denote, respectively, S: material (strip-like material, steel strip), 1 and 2: communication pipes, 3: roll-sealed chamber, 4: roll sealing device, 4A first roll-sealing device, 4B: second roll sealing device, 4C: third roll sealing device, 6: uppermost stream portion in a rapid cooling zone, 8: bridle roll, 10: zone (heating zone) in adjacent with the rapid cooling zone, 11: rapid cooling zone, 12: zone (cooling zone) in adjacent with the rapid cooling zone and 13: gas jet chamber.

BEST MODE FOR CARRYING OUT THE INVENTION

First Invention

Figure 6:
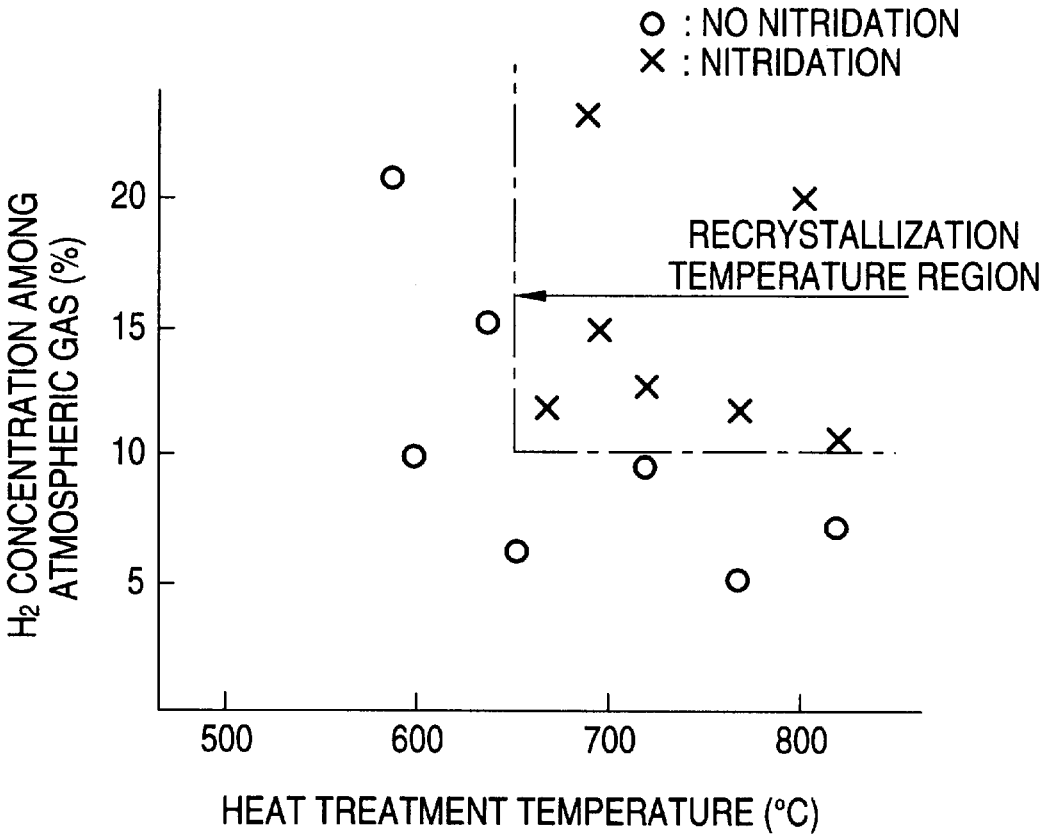
FIG. 6 is an explanatory view showing an influence of the temperature for the heat treatment and the hydrogen concentration in an atmospheric gas exerted on occurrence of nitridation at the surface layer of a steel strip.

As described above, assuming the atmospheric gas in the rapid cooling zone as a gas at high hydrogen concentration, by the discharge of the gas at high hydrogen concentration from the rapid cooling zone, increase of the hydrogen concentration is observed at the inside of the furnace in adjacent with the rapid cooling zone. As described above, recent study has provided a finding that the surface layer of a steel strip is hardened by nitridation when the hydrogen concentration is high during the heat treatment of the steel strip in a recrystallization step at high temperature. For example, FIG. 6 is an explanatory view showing the influence of the temperature for heat treatment and the hydrogen concentration in the atmospheric gas on the occurrence of nitridation at the surface layer of the steel strip, and it can be seen that nitridation occurs at the surface layer of the steel strip when the heat treatment is conducted under the condition of the hydrogen concentration exceeding 10% in a recrystallization temperature region.

In this case, presence or absence of nitridation is judged by the increase of hardness at the surface of the steel plate and the increase of the amount of nitrogen at the surface of the steel sheet (based on Auger spectral analysis).

Based on the finding described above, when a gas at high hydrogen concentration is used as the atmospheric gas in the rapid cooling zone, it is necessary to lower the hydrogen concentration to 10% or less in the slow cooling zone in adjacent with the rapid cooling zone and a soaking zone and a heating zone situated upstream to the slow cooling zone.

Accordingly, it is defined in the first invention that the hydrogen concentration in the atmospheric gas in the furnace zone for heating a strip-like material and in the furnace zone for keeping it after heating is controlled to 10% or lower.

Second Invention

In a continuous heat treatment furnace for a strip-like material, for example, a steel strip, a rapid cooling zone is disposed to a portion of a cooling zone for rapidly cooling the steel strip by gas jet cooling. In the second invention, in addition to the first invention, the tension Tu (kgf/mm$^2$) per unit cross section of the material is kept within a range capable of satisfying any one of the corresponding formulae (1) to (3) in accordance with the thickness t (mm), and the width W (mm) of the strip material in the rapid cooling zone, and a hydrogen-containing gas at a hydrogen concentration of 10% or higher is blown to the material. The reason is to be explained with reference to FIG. 7.

Figure 7:
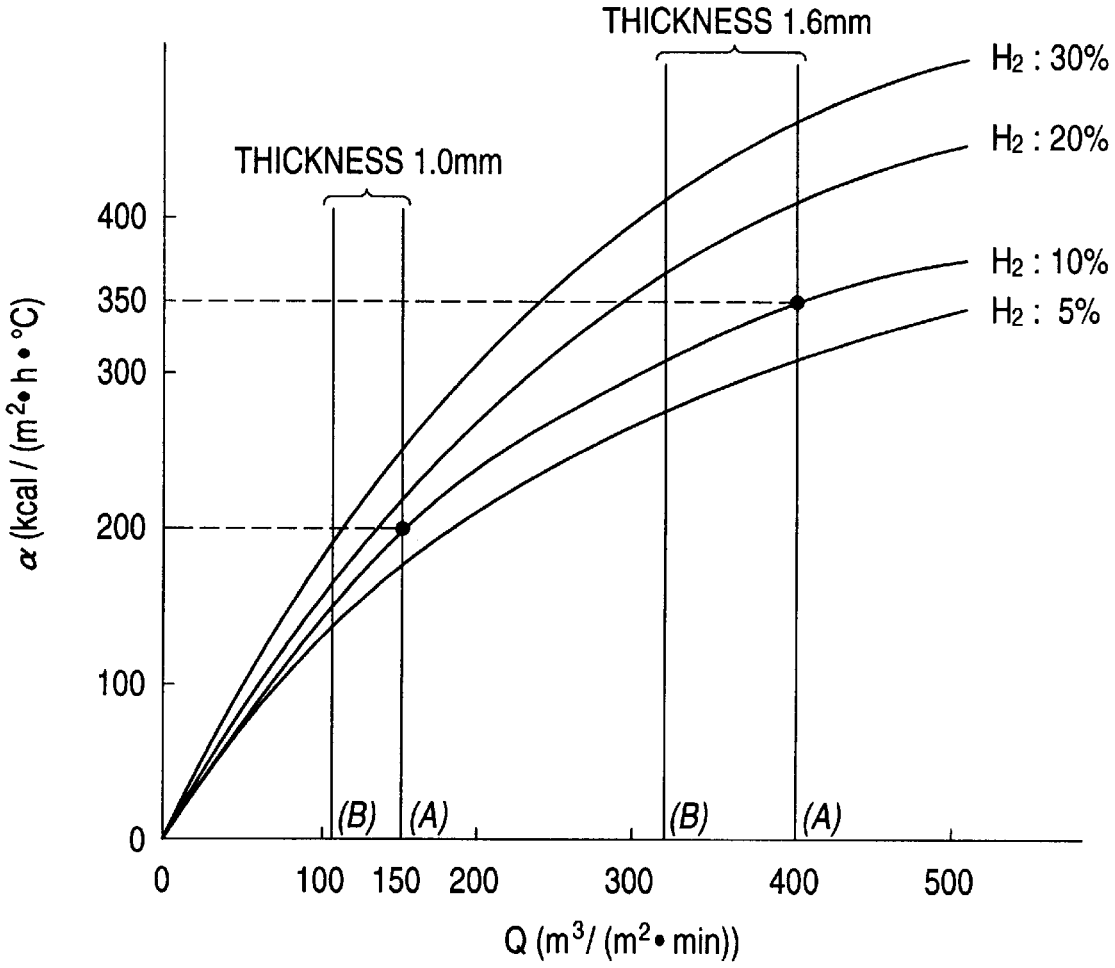
FIG. 7 is a graph showing a relationship between each of the blowing amount density Q, and the hydrogen concentration and the heat transfer coefficient α of the cooling gas in the rapid cooling zone.

FIG. 7 is a graph showing a relationship between each of the blowing amount density Q, the hydrogen concentration and the heat transfer coefficient α of the cooling gas in the rapid cooling zone, in which α increases substantially in proportion to the Q and the hydrogen concentration. The blowing amount density Q is obtained by the dividing the blowing amount blown to both surfaces of the steel strip by the area of one surface of the steel strip in the rapid cooling zone.

In this case, the value α necessary in the rapid cooling zone is different depending on the kind (kind of steel) of the material (steel sheet in this example) and the thickness. For example, for a BH steel sheet (steel sheet used for automobile steel sheets or the like provided with bake-hardenability), a cooling rate of 30° C./s or higher is necessary in the rapid cooling zone, which corresponds to α: 200 kcal/(m$^2$·h·° C.) or more for thickness of 1.0 mm, and α: 350 kcal/ (m$^2$·h·° C.) or more for thickness of 1.6 mm.

Since a predetermined value of α corresponding to the thickness must be ensured, it is preferable to determine a lowest limit for the hydrogen concentration, and it is also preferable to increase the blowing amount density Q depending on the thickness. On the other hand, Q must be controlled to less than a predetermined amount depending on the thickness.

Namely, it is advantageous to shorten the distance between a cooling gas jet nozzle and a strip-like material in view of the cooling efficiency but, if the blowing amount density Q is increased, the steel strip flaps and comes in contact with the cooling gas jet nozzles, tending to cause scratches. The value Q at which scratches are often caused depends on the thickness and the tension of the strip-like material, and takes a lower value as the thickness is decreased.

Referring to the relation with the tension, the limit of Q at which scratches are often caused is lowered as the tension is lower. FIG. 7 shows the limit of Q at which scratches are often caused for the thickness of 1.0 mm, and the thickness of 1.6 mm, in a case of (A), where $Tu=1.88-0.18\times t-0.00080\times W$ ($W<1350$ mm) and $Tu=1.10-0.00033\times W$ ($W\geqq 1350$ mm), and in a case of (B) where $Tu=1.78-0.18\times t-0.00080\times W$ ($W<1350$ mm) and $Tu=1.00-0.00033\times W$ ($W\geqq 1350$ mm). In a case of (A), the limit Q at which scratches are often caused is 150 m$^3$/(m$^2$, min) for the thickness of 1.0 mm, and 400 m$^3$/(m$^2$, min) for the thickness 1.6 mm, and the aimed value of α can be attained when a hydrogen concentration is 10% or more in both cases. On the other hand, in a case of (B) in which Tu is lower than the value described above, the aimed value of α can not be attained without flapping unless the hydrogen concentration is considerably increased.

If Tu is greater than the value in the right side of the formula corresponding to any of the formulae (1) to (3), there is a problem in view of the quality since buckling or plastic deformation of a steel strip tends to occur when it is wound around a hearth roll in the rapid cooling zone. In addition, the difference of the tension between the rapid cooling zone and the tension in the slow cooling zone or the soaking zone is excessively increased, and the excessive power of a motor for the bridle rolls is required, for example, for controlling the tension, to give economically undesired effects.

Accordingly, it is defined in the second invention that the hydrogen concentration in the rapid cooling zone is limited, and the tension of a material is kept within a range of the formula corresponding to any of the formulae (1) to (3) is also determined in the second invention. The signs for the coefficients are different in the formulae (1) to (3) concerned with thickness since it is preferred to conduct analyses based on experimental formulae attaching an importance to prevention of buckling when using thin sheets and based on experimental formulae attaching an importance to prevention of plastic deformation of sheets caused by an excessive tension and for the step reduction of difference of tension between the sheet and a joint material when using thick sheets.

In order to satisfy the definition of the first and second inventions, it requires a sealing device capable of sealing a hydrogen-containing gas in the rapid cooling zone within a range that the hydrogen concentration in the slow cooling zone in adjacent with the rapid cooling zone for blowing a hydrogen-containing gas (a high hydrogen concentration gas at a hydrogen concentration of 10% or higher in the second invention) and a soaking zone and a heating zone situated upstream to the slow cooling zone does not exceed 10%, and a sealing device having such a high performance can be realized by third to fifth inventions.

Third Invention

Figure 2:
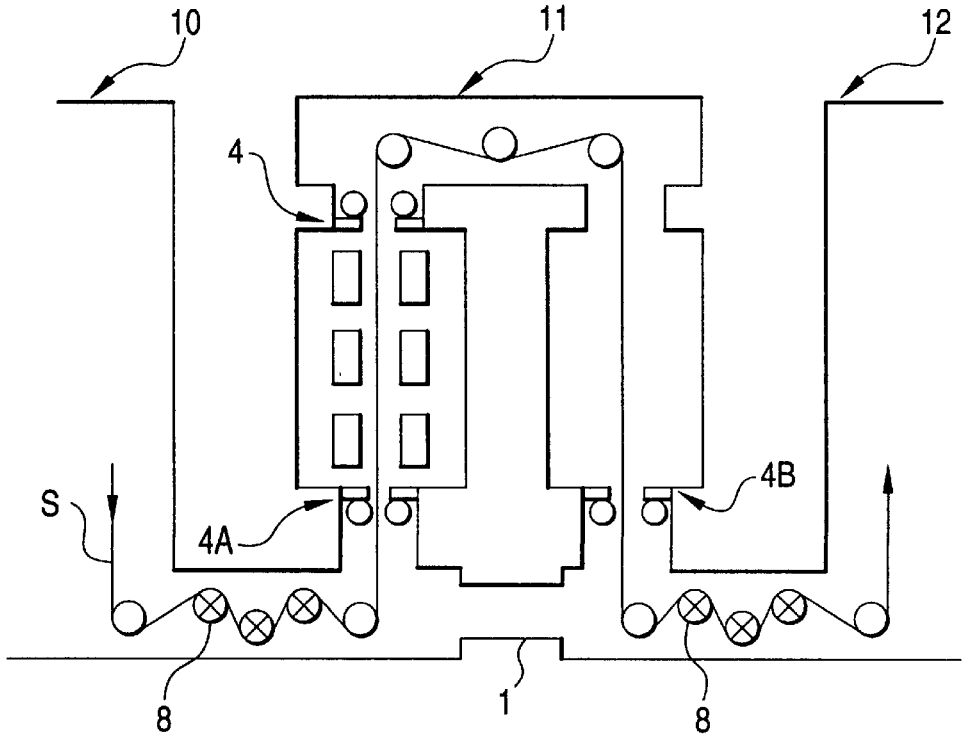
FIG. 2 is a schematic view illustrating an example of a continuous heat treatment furnace according to the third invention.

FIG. 2 is a schematic view illustrating an example of a continuous heat treatment furnace concerning the third invention. As shown in the drawing, in the continuous heat treatment furnace, one of a plurality of furnace zones except for the first and last zones is a rapid cooling zone 11 for rapidly cooling a material by blowing an atmospheric gas, which comprises a first roll-sealing device 4A at the entrance of the roll-sealed chamber and a second roll-sealing device 4B at the exit thereof sealing means for as atmospheric gas, and in which the inlet of the first roll-sealing device 4A and the outlet of the second roll-sealing device 4B are connected by a communication pipe 1. Such connecting means is not limited to the communication pipe of this example, but may be constituted by joining portions of furnace shells to be connected to each other. In FIG. 2, portions identical with or corresponding to those in FIG. 4 carry the same references, for which explanations are omitted.

With the constitution described above, since the furnace pressure at the upstream and the downstream on both sides of the rapid cooling zone are substantially identical with each other, even if the furnace pressure fluctuates, for example, on the slow cooling zone, the fluctuation is moderated by the exchange of the atmosphere with that at the upstream, and the furnace pressure can be controlled only by taking the balance between two zones, that is, the rapid cooling zone and other zones. Of course, entry of a trace amount of gas into the rapid cooling zone on the inlet and discharge of a trace amount of gas from the rapid cooling zone on the outlet are tolerable in view of the balance with the entrained stream, but the amount of the gas may be much smaller compared with the amount of the gas stream which might occur by the furnace pressure distribution (worsening of balance of furnace pressures). In addition, at the upstream of the rapid cooling zone having a worry of nitridation, since a gas stream in the direction of flowing to the rapid cooling zone is present and this is also effective in view of prevention of nitridation.

Further, the atmospheric pressure in the communication pipe 1 is an average pressure of the entrance and the exit of the rapid cooling zone, it is more preferred to control the furnace pressure relative to the rapid cooling zone by disposing a furnace pressure gauge (not illustrated). With the constitution as described above, the difference of the furnace pressure between the heating zone 10 and the cooling zone 12 is eliminated, so that mixing of the atmospheric gases between the rapid cooling zone 11 and the zone 10 or 12 in adjacent with the rapid cooling zone caused by the difference of the furnace pressures is suppressed.

Fourth Invention

Figure 3:
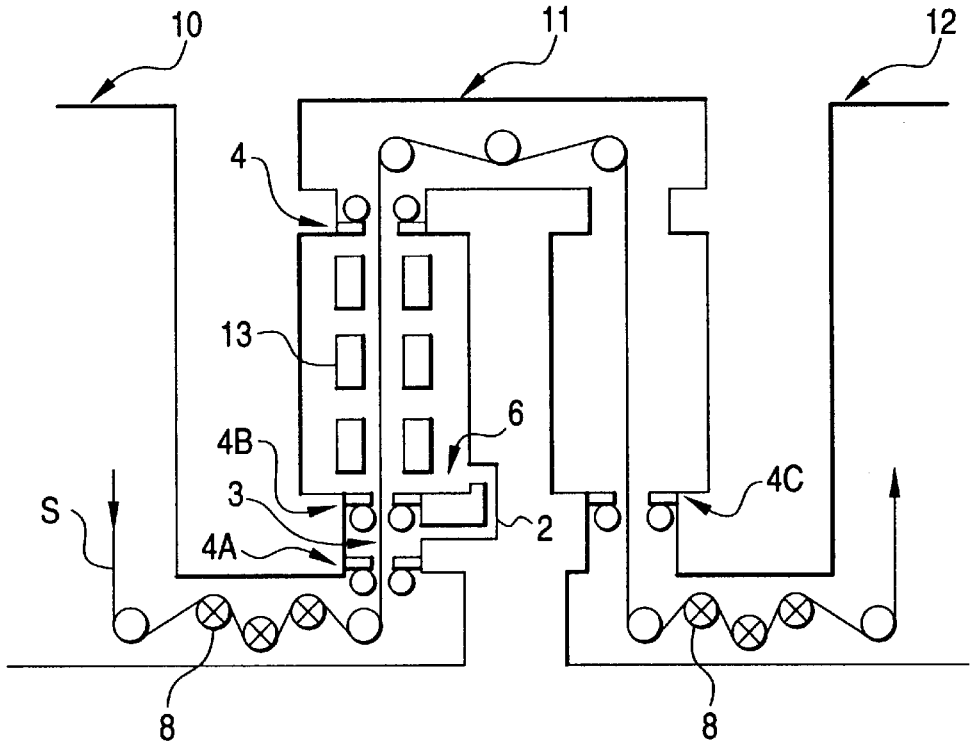
FIG. 3 is a schematic view illustrating an example of a continuous heat treatment furnace according to the fourth invention.

FIG. 3 is a schematic view illustrating an example of the continuous heat treatment furnace according to the fourth invention. As shown in the drawing, in the continuous heat treatment furnace, one of the plurality of furnace zones except for the first and last zones is a rapid cooling zone 11 for rapidly cooling a material by blowing an atmospheric gas, which comprises a roll-sealed chamber 3 at the entrance partitioned by first and second roll sealing devices 4A and 4B from the upstream and a third roll sealing device 4C at the exit disposed as sealing means for atmospheric gas, and in which the roll-sealed chamber 3 and an uppermost stream portion 6 in the rapid cooling zone are connected by a communication pipe 2. Such connecting means is not restricted only to the communication pipe of this example but may be constituted, for example, by joining portions of furnace shells to be connected to each other. In FIG. 3, portions identical with or corresponding to those in FIG. 4 carry the same references, for which explanations are omitted.

The constitution described above eliminates the difference of the furnace pressure between the inside and outside at the entrance of the rapid cooling zone 11, which has been caused by fluctuation of gas jetting pressure at a place where gas jet chambers 13 are disposed, so that mixing of the atmospheric gases between the rapid cooling zone 11 and the heating zone 10 caused by the difference of furnace presser can be prevented.

Fifth Invention

Figure 1:
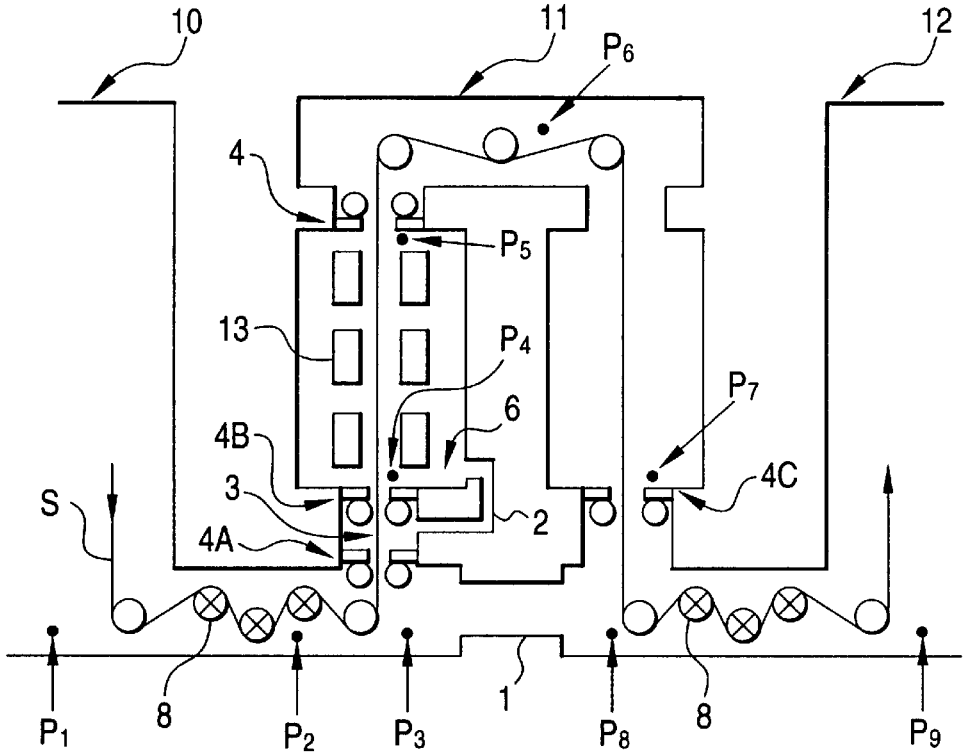
FIG. 1 is a schematic view illustrating an example of a continuous heat treatment furnace according to the fifth invention.

FIG. 1 is a schematic view illustrating an example of the continuous heat treatment furnace according to the fifth invention. As shown in the drawing, in the continuous heat treatment furnace, one of the plurality of furnace zones except for the first and last zones is a rapid cooling zone 11 for rapidly cooling a material by blowing an atmospheric gas, which comprises a roll-sealed chamber 3 at the entrance partitioned by first and second roll sealing devices 4A and 4B from the upstream and a third roll sealing device 4C at the exit as sealing means for atmospheric gas, and in which the inlet of the first roll-sealing device 4A and the outlet of the third roll-sealing device 4C are connected by a communication pipe 1, and the roll-sealed chamber 3 and an uppermost stream portion 6 in the rapid cooling zone are connected by a communication pipe 2. Such connecting means is not limited to the communication pipe of this example, but may be constituted also by joining portions of furnace shells to be connected to each other. In FIG. 1, portions identical with or corresponding to those in FIG. 4 carry the same references, for which explanations are omitted.

The constitution described above eliminates, the difference of furnace pressure between the heating zone 10 and the cooling zone 12, so that mixing of the atmospheric gases between the rapid cooling zone 11 and the zones 10 or 12 in adjacent with the rapid cooling zone, which has been caused by the difference of the furnace pressures. At the same time, the difference of the furnace pressures between the inside and the outside at the entrance of the rapid cooling zone 11 caused by the fluctuation of the gas jetting pressure at a place where the gas jet chambers 13 are disposed is eliminated, so that mixing of the atmospheric gases between the rapid cooling zone 11 and the heating zone 10 caused by the difference of the furnace pressure can be suppressed.

Further, as apparent from the foregoing explanations the third to fifth inventions can be practiced merely by simple modification for facilities since this is attained by disposing a gas communication channel in an existent continuous heat treatment furnace, in addition to a sheet passing path between two points in the furnaces designated by the present invention.

Sixth Invention

As described above, the tension in the rapid cooling zone is kept within a range of any of the formulae (1) to (3) in the second invention. However, since the yield stress of the steel strip is lowered as the temperature elevation of the steel strip in the heating zone, if the tension is excessively increased, buckling of the steel strip upon winding around the roll in the heating zone (so called heat buckling) is observed. In actual operation, a steel strip can be passed at an increased tension over the entire continuous heat treatment furnace including the heating zone if the thickness of the strip is relatively large. However, upon passing a steel sheet of a relatively small thickness, it must be passed at a lowered tension in order to prevent heat buckling in the heating zone, and at a higher tension in order to inhibit flapping in the rapid cooling zone. It is thus necessary to change the tension between the heating zone and the rapid cooling zone, so that bridle rolls are disposed as suitable means therefor, in the sixth invention, before and after the rapid cooling zone in any of the third to fifth inventions. This can keep the tension in the rapid cooling zone within a range of any one of the formulae (1) to (3) while keeping the tension lower in the heating zone.

Further, in the present invention, the gap between the sealing rolls of each roll sealing device and a steel strip is preferably 5 mm or less. As the sealing-rolls, those of water-cooling type or those made of a roll material having a small heat expansion coefficient, for example, ceramics are preferred.

EXAMPLE

The third, fourth and fifth inventions were practiced as shown in FIG. 2, FIG. 3 and FIG. 1, being directed to a continuous heat treatment furnace for cold-rolled steel strips, which are referred to as Example 1, Example 2 and Example 3. As can be seen from FIG. 2, FIG. 3 and FIG. 1, Example 1, Example 2 and Example 3 have such a constitution of facilities that bridle rolls 8 are disposed before and after the rapid cooling zone so as to control the tension in the rapid cooling zone, separately, from the tension in the heating zone according to the sixth invention.

Example 4 shows an example assuming a state not satisfying the conditions of the sixth invention (with no bridle rolls) in the fifth invention (same facilities as in Example 3 shown in FIG. 1), and making the tension in the rapid cooling zone equal with the tension in the heating zone which is lower than the range of the formula corresponding to any of the formulae (1) to (3) (not satisfying the conditions of the second invention).

Figure 4:
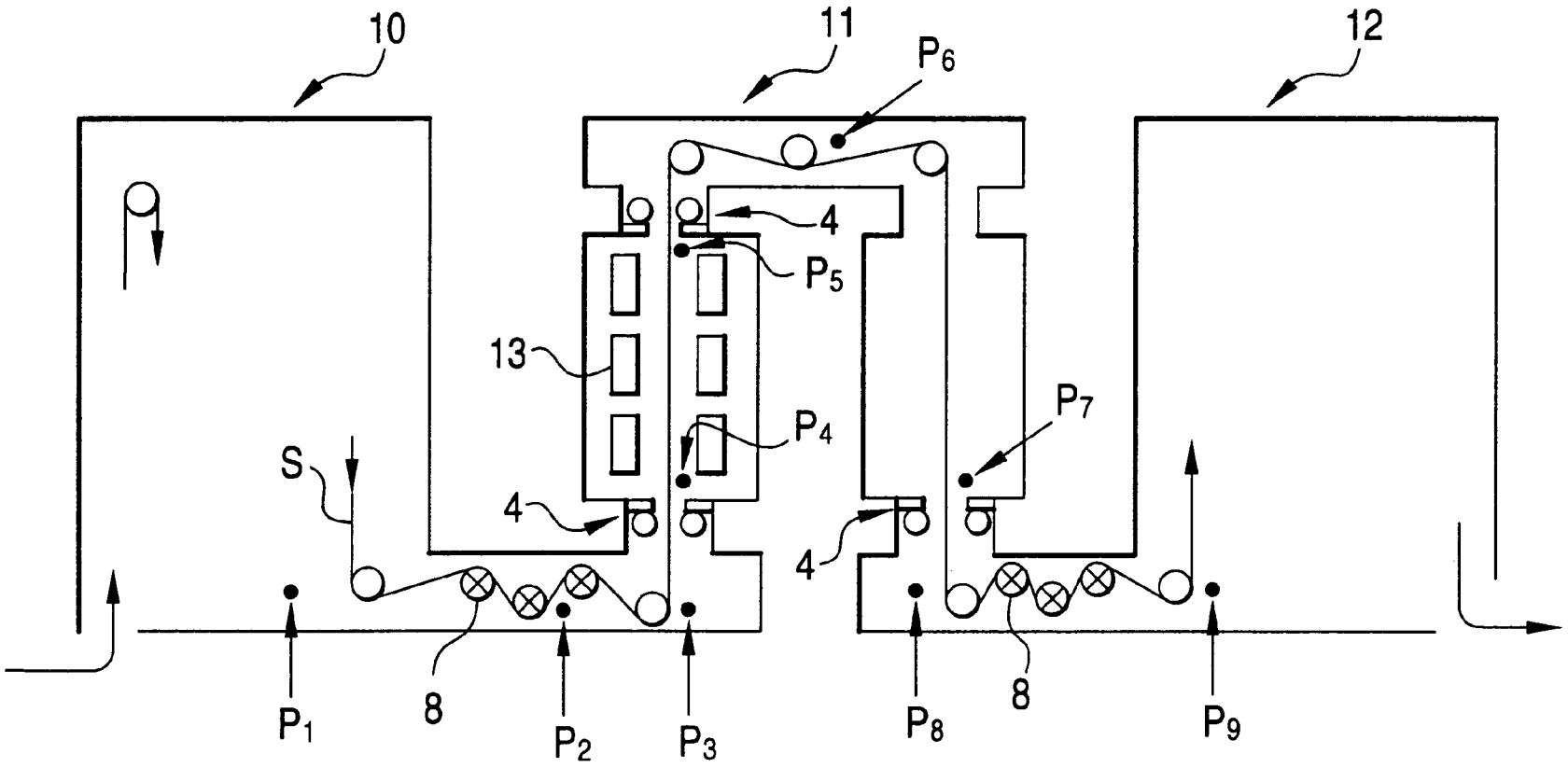
FIG. 4 is a schematic view illustrating an example of an existent continuous heat treatment furnaces.

The amount of an atmospheric gas at high hydrogen concentration (hydrogen concentration: about 30%) used in the rapid cooling zone and the frequency of occurrence of nitridation in steel strips were investigated for Example 1, Example 2, Example 3 and Example 4 described above. Further, results of the investigation (comparative examples) when operating an existent continuous heat treatment furnace while satisfying the formula corresponding to any of the formulae (1) to (3) for the tension in the furnace as shown in FIG. 4 are determined as a comparative example. FIG. 4 shows an example of an existent furnace equipped with bridle rolls but out of the range of the third to fifth inventions. Further in Example 3, a static pressure and a hydrogen concentration in the atmospheric gas were measured at points P1 to P9 for the rapid cooling zone and before and after the zone (refer to FIG. 1: same positions as the measuring points in FIG. 4) during passage of a strip material having 0.8 mm thickness and 1250 mm width at a line speed of 400 mpm. In the continuous heat treatment furnace, the furnace zone preceding to the rapid cooling zone is a slow cooling zone and the furnace zone subsequent to the rapid cooling zone is an overaging zone, and an atmospheric gas is a HN gas.

Figure 5:
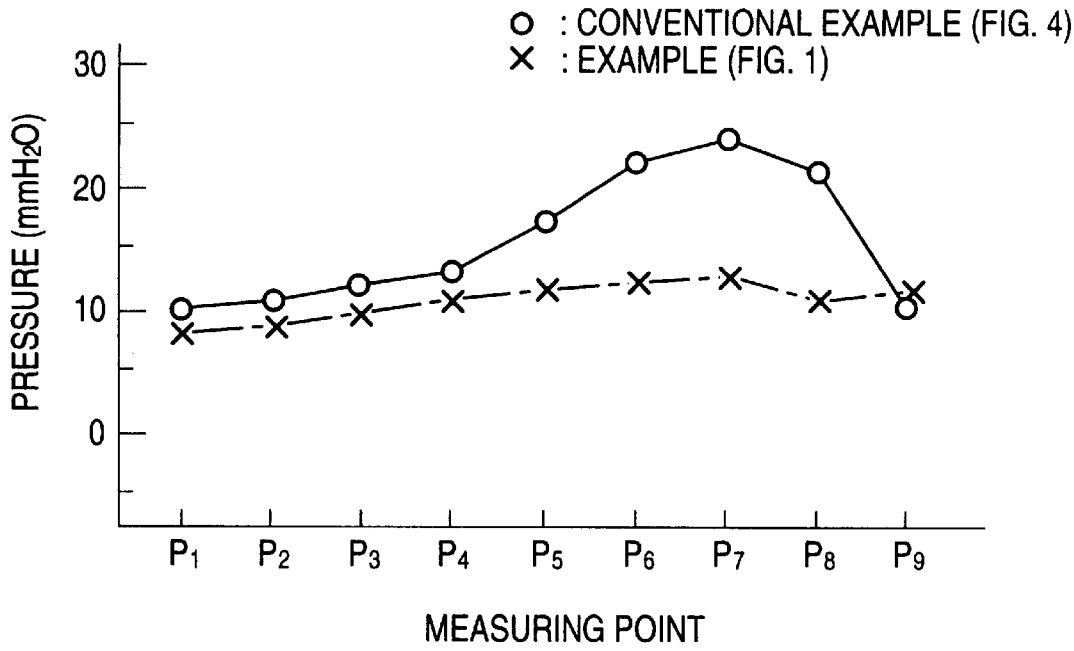
FIG. 5 is a graph showing (*a*) a pressure distribution and (*b*) a hydrogen concentration distribution of an atmospheric gas before and after a rapid cooling zone in the existent furnace and in Example 3.
Figure 5:
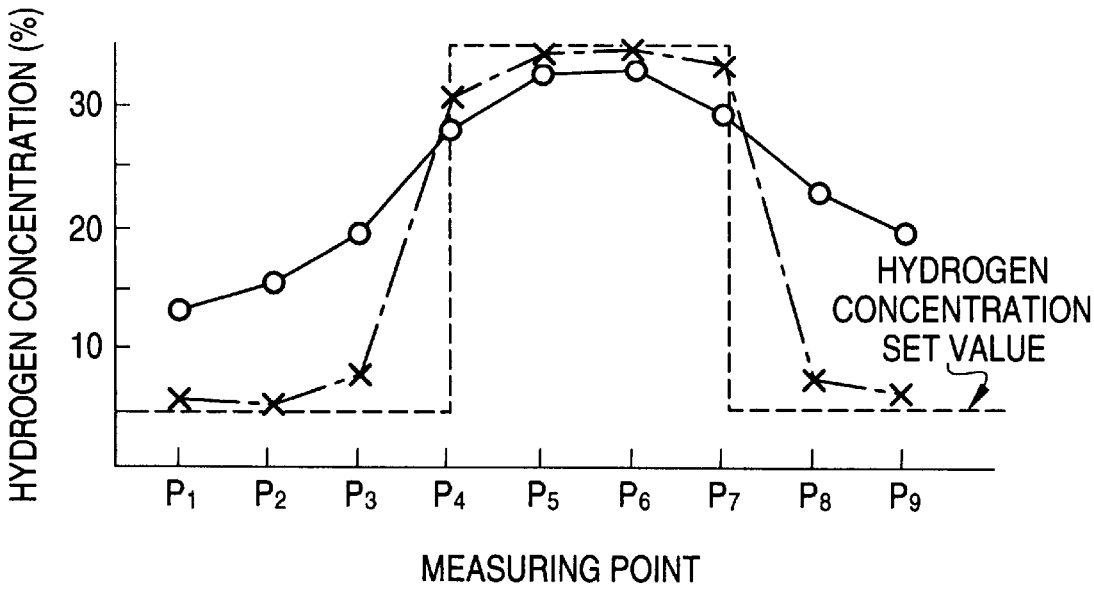

The results of the measurement for the static pressure and the results of measurements for the hydrogen concentration in the atmospheric gas in Example 3 are shown being overlapped on the FIG. 5(*a*) and FIG. 5(*b*), and the amount of atmospheric gas used and the frequency of occurrence of nitridation in Examples 1 to 3 and the comparative example are shown in Table 1. The amount of the atmospheric gas used and the frequency of occurrence of nitridation in Table 1 are shown by relative indexes based on the values in comparative example as 100.

It is apparent from FIG. 5 and Table 1 that mixing of the atmospheric gases in the rapid cooling zone and that in the zones in adjacent with the rapid cooling zone is prevented effectively thereby enabling to reduce the amount of the atmospheric gases used to prevent nitridation as well.

Figure 8:
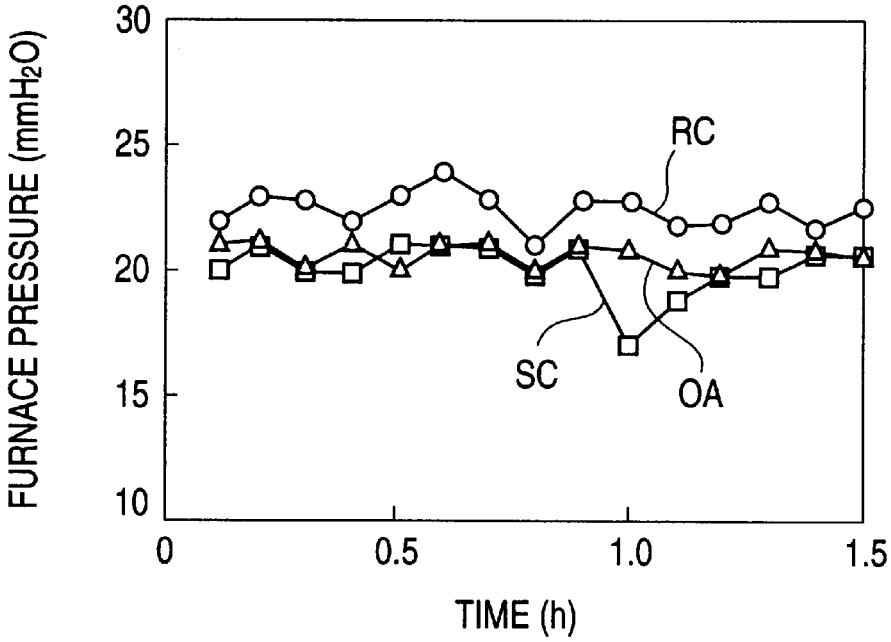
FIG. 8 is graph showing the change with time of the furnace pressure (*a*) and the hydrogen concentration (*b*) for Example 1.
Figure 8:
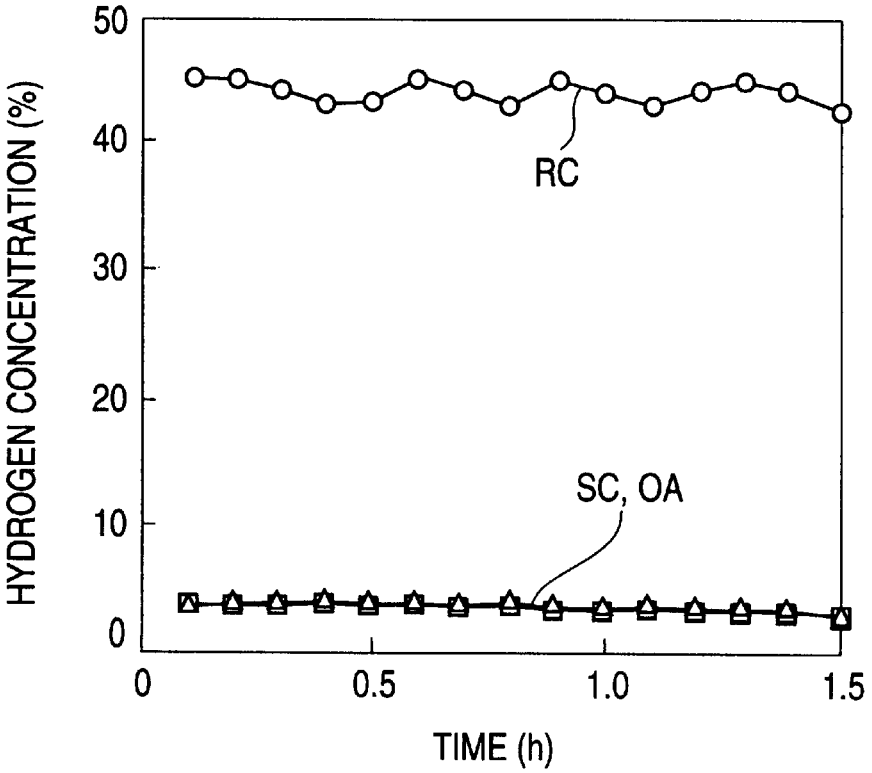
Figure 9:
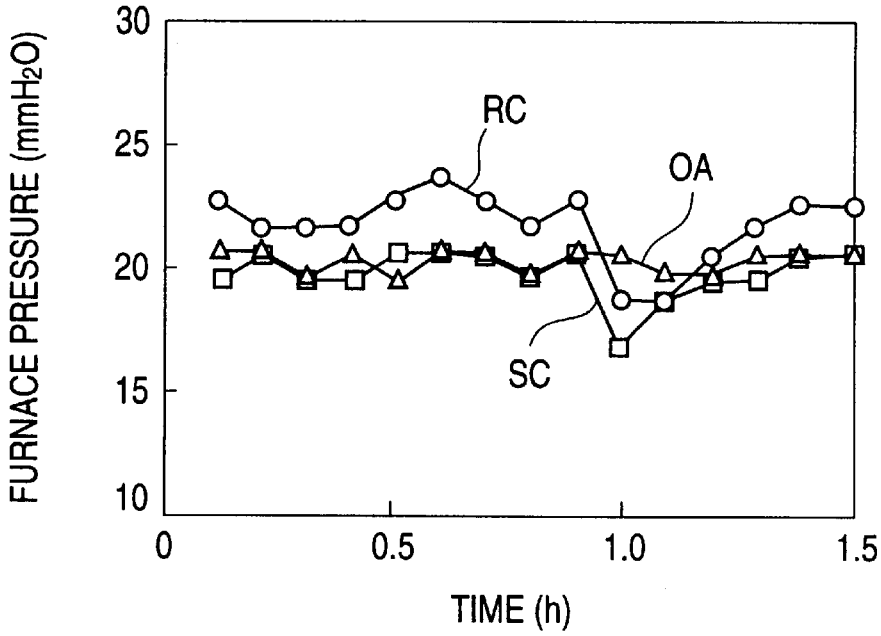
FIG. 9 is a graph showing the change with time of the furnace pressure (*a*) and the hydrogen concentration (*b*) in a comparative example.
Figure 9:
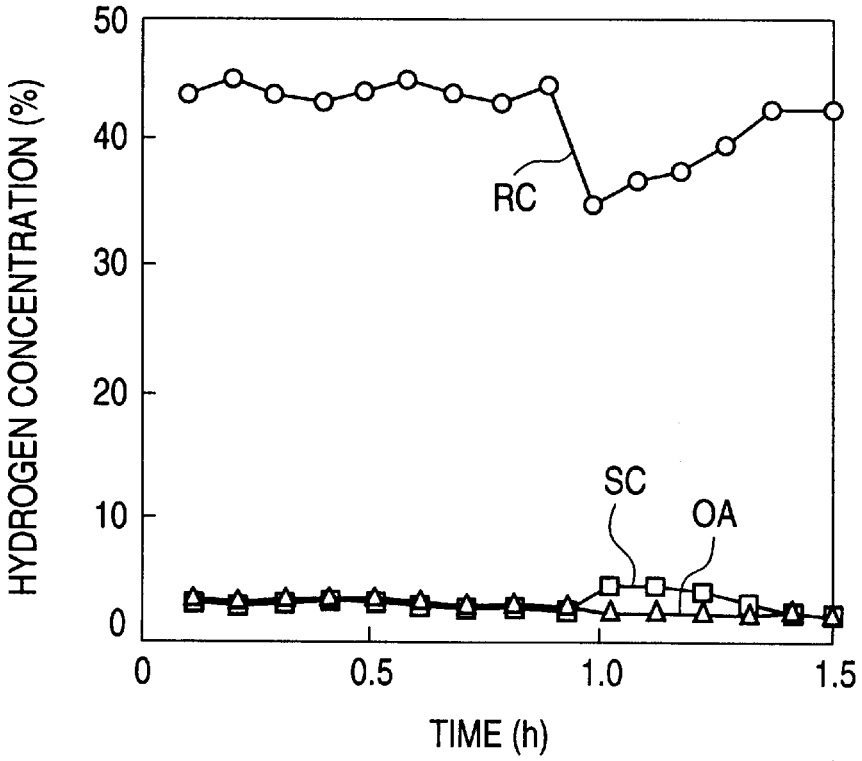

Further, examples of changes with time of the furnace pressure and the hydrogen concentration in the rapid cooling zone (RC), slow cooling zone (SC) and averaging zone (OA) are shown for Example 1 (FIG. 8) and the comparative example (FIG. 9), and it can be seen that even if the furnace pressure fluctuates in the slow cooling, the pressure balance relative to the rapid cooling zone is kept and the hydrogen concentration is not changed by gas streams between the rapid cooling zone and the zones before and after the rapid cooling zone in the present invention.

Further, as shown by the tension in the rapid cooling zone (controlled value) and the amplitude of flapping of the steel strip in the rapid cooling zone (investigated values) also described in Table 1, since the tension in the rapid cooling zone is controlled within a range of the formula (1), separately, from the tension in the heating zone by bridle rolls disposed before and after the rapid cooling zone in Example 1, Example 2 and Example 3, the amplitude of the flapping of the steel strip in the rapid cooling zone can be suppressed with no occurrence of heat buckling in the heating zone. On the other hand, in Example 4, since the tension is lower than the range of the formula corresponding to any one of the formulae (1) to (3), the amplitude of the flapping of the steel strip was increased due to the blowing of the cooling gas in the rapid cooling zone and the steel strip was in contact with the top end of the cooling gas jet nozzle to cause scratches. The value of $\alpha$ was also slightly lowered compared with that in Example 3 by the influence of the flapping of the steel strip. In Example 4, the flapping subsides if the blowing amount density Q is reduced, but it is difficult in this case to keep the value of α to greater than 180 kcal/ ($m^2$·h·° C.) (value at which a cooling rate of 30° C./s can be ensured at 0.8 mm thickness) or greater than 350 kcal/($m^2$·h·° C.) (value at which a cooling rate of 30° C./s can be ensured at 1.6 mm thickness).

Generally, the amplitude of the flapping of the steel strip increases as the passing speed is increased, and the blowing amount of the cooling gas is increased. The amplitude of the flapping can be reduced by disposing the bridle rolls before and after the rapid cooling zone according to the sixth invention and by controlling the tension in the rapid cooling zone according to the second invention. As a result, since the distance between the steel strip and the top end of the cooling gas jetting nozzle can be decreased, higher cooling efficiency can be attained at an identical cooling gas blowing amount.

INDUSTRIAL APPLICABILITY

As described above, the present invention can realize a continuous heat treatment furnace capable of preventing mixing of atmospheric gases between a rapid cooling zone and a zones in adjacent with the rapid cooling zone (heating zone, cooling zone or the like) by a simple means upon practicing gas jet cooing at a high efficiency with a hydrogen concentration of an atmospheric gas of 10% or higher in a rapid cooling zone of a gas jet cooling system and can provide excellent effect capable of remarkably improving the atmospheric gas unit, particularly, in a continuous heat treatment for steel strips, and further eliminating the worry of occurrence of nitridation in a heating zone by the effect of an atmospheric gas at a high hydrogen concentration.

TABLE 1

(No. 1)

| | | Example 1 | Example 2 | Example 3 | Example 4 | Comparative Example |
|---|---|---|---|---|---|---|
| Amount of consumption of atmospheric gas (relative index) | | 85 | 75 | 45 | 45 | 100 |
| Frequency of occurrence of nitridation (relative index) | | 5 | 3 | 0 | 0 | 100 |
| Conditions when a steel strip of t 0.8 mm × W 1250 mm is passed at LS = 400 mpm | Tension in rapid cooling zone | 800 kgf (0.80 kgf/$mm^2$) | 1000 kgf (1.00 kgf/$mm^2$) | 1200 kgf (1.20 kgf/$mm^2$) | 600 kgf (0.60 kgf/$mm^2$) | 1200 kgf (1.20 kgf/$mm^2$) |
| | Amplitude of flapping | <50 mm | <50 mm | <50 mm | 150–200 mm Large flapping, occurrence of scratches on front and back surfaces of steel strips | <50 mm |
| | Blowing amount density: Q | 150 $m^3$/($m^2$/min) | 150 $m^3$/($m^2$/min) | 150 $m^3$/($m^2$/min) | 150 $m^3$/($m^3$/min) | 150 $m^3$/($m^2$/min) |
| | Heat transfer coefficient: α | 240 kcal/ ($m^2$/h/° C.) | 240 kcal/ ($m^2$/h/° C.) | 240 kcal/ ($m^2$/h/° C.) | 230 kcal/ ($m^2$/h/° C.) | 220 kcal/ ($m^2$/h/° C.) |
| Conditions when a steel strip of t 1.6 mm × W 1250 mm is passed at LS = 400 mpm | Tension in rapid cooling zone | 2200 kgf (1.10 kgf/$mm^2$) | 2100 kgf (1.05 kgf/$mm^2$) | 2000 kgf (1.00 kgf/$mm^2$) | 1000 kgf (0.50 kgf/$mm^2$) | 2000 kgf (1.00 kgf/$mm^2$) |
| | Amplitude of flapping | 50–100 mm | 50–100 mm | 50–100 mm | 150–200 mm Large flapping, occurrence of scratches on front and back surfaces of steel strips | 50–100 mm |
| | Blowing amount density: Q | 400 $m^3$/($m^2$/min) | 400 $m^3$/($m^2$/min) | 400 $m^3$/($m^2$/min) | 400 $m^3$/($m^2$/min) | 400 $m^3$/($m^2$/min) |
| | Heat transfer coefficient: α | 470 kcal/ ($m^2$/h/° C.) | 470 kcal/ ($m^2$/h/° C.) | 470 kcal/ ($m^2$/h/° C.) | 450 kcal/ ($m^2$/h/° C.) | 420 kcal/ ($m^2$/h/° C.) |

LS: Strip-passing speed, mpm: m/min

TABLE 2

(No. 2)

| | | Example 1 | Example 2 | Example 3 | Example 4 | Comparative Example |
|---|---|---|---|---|---|---|
| Conditions when a steel strip of t 0.8 mm × W 1509 mm is passed at LS = 400 mpm | Tension in rapid cooling zone | 1200 kgf (1.00 kgf/$mm^2$) | 960 kgf (0.80 kgf/$mm^2$) | 720 kgf (0.60 kgf/$mm^2$) | 600 kgf (0.50 kgf/$mm^2$) | 720 kgf (0.60 kgf/$mm^2$) |
| | Amplitude of flapping | <50 mm | <50 mm | <50 mm | 150–200 mm Large flapping, occurrence of scratches on front and back surfaces of steel strips | <50 mm |
| | Blowing amount density: Q | 150 $m^3$/$m^2$/min) | 150 $m^3$/$m^2$/min) | 150 $m^3$/($m^2$/min) | 150 $m^3$/($m^2$/min) | 150 $m^3$/($m^2$/min) |

TABLE 2-continued (No. 2)

| | | Example 1 | Example 2 | Example 3 | Example 4 | Comparative Example |
|---|---|---|---|---|---|---|
| | Heat transfer coefficient: α | 240 kcal/ ($m^2$/h/° C.) | 240 kcal/ ($m^2$/h/° C.) | 240 kcal/ ($m^2$/h/° C.) | 230 kcal/ ($m^2$/h/° C.) | 220 kcal/ ($m^2$/h/° C.) |
| Conditions when a steel strip of t 1.6 mm × W 1500 mm is passed at LS = 400 mpm | Tension in rapid cooling zone | 1680 kgf (0.70 kgf/$mm^2$) | 2160 kgf (0.90 kgf/$mm^2$) | 2640 kgf (1.10 kgf/$mm^2$) | 960 kgf (0.40 kgf/$mm^2$) | 2640 kgf (1.10 kgf/$mm^2$) |
| | Amplitude of flapping | 50–100 mm | 50–100 mm | 50–100 mm | 150–200 mm Large flapping, occurrence of scratches on front and back surfaces of steel strips | 50–100 mm |
| | Blowing amount density: Q | 400 $m^3$/$m^2$/min) | 400 $m^3$/($m^2$/min) | 400 $m^3$/$m^2$/min) | 400 $m^3$/($m^2$/min) | 400 $m^3$/($m^2$/min) |
| | Heat transfer coefficient: α | 470 kcal/ ($m^2$/h/° C.) | 410 kcal/ ($m^2$/h/° C.) | 470 kcal/ ($m^2$/h/° C.) | 450 kcal/ ($m^2$/h/° C.) | 420 kcal/ ($m^2$/h/° C.) |

LS: Strip-passing speed, mpm: m/min

What is claimed is:

1. A continuous heat treatment furnace having a plurality of furnace zones arranged successively for the heat treatment of a strip-like material in an atmospheric gas, wherein an intermediate furnace zone is a rapid cooling zone for rapidly cooling the material by blowing an atmospheric gas, which comprises a first roll sealing device at the entrance and a second roll sealing device at the exit for sealing off atmospheric gas, and in which a furnace zone upstream of the first roll sealing device is in gaseous communication with a furnace zone downstream of the second roll sealing device.

2. A continuous heat treatment furnace as defined in claim 1, which comprises bridle rolls before and after the rapid cooling zone.

3. A continuous heat treatment furnace having a plurality of furnace zones arranged successively for the heat treatment of a strip-like material in an atmospheric gas, wherein an intermediate furnace zone is a rapid cooling zone for rapidly cooling materials by blowing an atmospheric gas, said intermediate furnace zone having a roll-sealed chamber at its inlet delimited by first and second roll sealing devices, and a third roll sealing device at its outlet for sealing atmospheric gas, wherein the roll-sealed chamber and an upstream portion of said intermediate furnace zone are in gaseous communication.

4. A continuous heat treatment furnace as defined in claim 3, wherein the inlet of the first roll sealing device and the outlet of the third roll sealing device are further connected.

5. A method of cooling a continuous heat treatment furnace comprising heat treating a strip-like material in an atmospheric gas, heating the strip-like material in the course of the treatment, and then rapidly cooling it by blowing a hydrogen-containing gas, wherein the hydrogen concentration of the atmospheric gas in the furnace zone for heating the strip-like material and the furnace zone for keeping it after the heating is controlled to 10% or lower, and the tension of the material per unit cross section Tu (kgf/$mm^2$) is kept within a range capable of satisfying the following conditions depending on the thickness t (mm) and the width W (mm) of the strip material, and a hydrogen-containing gas at a hydrogen concentration of 10% or higher is blown to the material in the rapid cooling zone for conducting rapid cooling, wherein:

(a) under the condition: W<1350 mm:

$$1.88-0.18\times t-0.00080\times W \leqq Tu \leqq 2.38-0.11\times t-0.00084\times W \quad (1)$$

(b) under the condition: W≧1350 mm and t≦0.85 mm:

$$0.73+0.38\times t-0.00030\times W \leqq Tu \leqq 1.23+0.35\times t-0.00028\times W \quad (2)$$

(c) under the condition: W≧1350 mm and t>0.85 mm:

$$1.10-0.00033\times W \leqq Tu \leqq 1.54-0.00029\times W \quad (3).$$

* * * * *